US008336674B2

(12) United States Patent
Kleppe et al.

(10) Patent No.: US 8,336,674 B2
(45) Date of Patent: Dec. 25, 2012

(54) DEVICE FOR A GUIDE RAIL

(76) Inventors: Jan Martin Kleppe, Naersnes (NO); Havard Aurdal, Hafrsfjord (NO)

( * ) Notice: Subject to any disclaimer, the term of this patent is extended or adjusted under 35 U.S.C. 154(b) by 385 days.

(21) Appl. No.: 12/439,821

(22) PCT Filed: Aug. 29, 2007

(86) PCT No.: PCT/NO2007/000305

§ 371 (c)(1),
(2), (4) Date: Mar. 3, 2009

(87) PCT Pub. No.: WO2008/030100

PCT Pub. Date: Mar. 13, 2008

(65) Prior Publication Data

US 2010/0193291 A1 Aug. 5, 2010

(30) Foreign Application Priority Data

Sep. 4, 2006 (NO) ..... 20063936

(51) Int. Cl.
*E04G 3/00* (2006.01)

(52) U.S. Cl. ..... 182/82; 182/36

(58) Field of Classification Search ..... 182/36, 182/82

See application file for complete search history.

(56) References Cited

U.S. PATENT DOCUMENTS

| | | | | |
|---|---|---|---|---|
| 3,059,721 | A | 10/1962 | Straw | |
| 3,391,757 | A | 7/1968 | Duke et al. | |
| 4,396,092 | A | 8/1983 | Thompson | |
| 5,244,193 | A * | 9/1993 | Hehr | 269/99 |
| 6,182,401 | B1 * | 2/2001 | McManus et al. | 52/67 |
| 6,874,283 | B1 * | 4/2005 | Hindle | 52/67 |
| 2003/0178254 | A1 * | 9/2003 | Swanenberg et al. | 182/142 |
| 2004/0040234 | A1 * | 3/2004 | Davison et al. | 52/270 |
| 2005/0006178 | A1 * | 1/2005 | Korchagin et al. | 187/239 |
| 2005/0284078 | A1 * | 12/2005 | Marsland | 52/642 |
| 2007/0119331 | A1 * | 5/2007 | Korchagin et al. | 104/307 |
| 2007/0186501 | A1 * | 8/2007 | Kuelker | 52/506.06 |

FOREIGN PATENT DOCUMENTS

| | | |
|---|---|---|
| DE | 20110062 | 10/2001 |
| WO | WO-0214623 | 2/2002 |

* cited by examiner

*Primary Examiner* — Alvin Chin Shue
(74) *Attorney, Agent, or Firm* — Patterson & Sheridan, L.L.P.

(57) ABSTRACT

A device for a guide rail (1) for a scaffold (2), in which the guide rail (1) is connected to a building (4), and wherein the guide rail (1) is movable between an inactive, stowed away position and an active position.

7 Claims, 4 Drawing Sheets

II-II

III-III

DEVICE FOR A GUIDE RAIL

This invention relates to a guide rail. More specifically, it concerns a guide rail for a scaffold, in which the guide rail is connected to a building, the guide rail being movable between an inactive, stowed away position and an active position.

Due to official requirements, among other things, scaffolds or mobile working platforms are increasingly used during works at height.

Traditionally, use of scaffolds represents a relatively cumbersome and cost-driving solution for simple work operations, for example for painting and other types of maintenance of dwellings.

Oftentimes, mobile work platforms are practical to use, but they may be obstructed by insufficient space or other obstructions.

It is known to use simple, movable scaffolds arranged in a manner allowing them to be hung from a suspension on a facade of a building, and which may be moved along the facade as the work progresses.

If the movable scaffold depends on a guide rail being attached to the facade, the guide rail may appear ugly on the facade of the building if not dismantled after completion of the work.

The object of the invention is to remedy or reduce at least one of the disadvantages of the prior art.

The object is achieved by means of features disclosed in the following description and in the subsequent claims.

A guide rail according to the invention is provided for a scaffold, in which the guide rail is connected to a-building, characterized in that the guide rail is movable between an inactive, stowed away position and an active position.

Advantageously, the guide rail is connected to the building by means of at least one telescopic guide.

Alternatively, the guide rail may be connected to the building by means of a rotatable suspension.

During use the scaffold is connected to the guide rail by means of pulleys. Typically, the scaffold is provided with two sets of pulleys, each set of pulleys comprising at least one pulley capable of rolling towards an upper edge portion of the guide rail, and one pulley capable of rolling towards a lower edge portion of the guide rail.

The guide rail, when in its inactive position, most advantageously forms a part of a facade cladding of the building. In this context, the facade cladding is not limited to wooden boarding.

The guide rail, when in its inactive position, advantageously seals against the remainder of the facade cladding, for example by means of a seal element. Advantageously, the seal element may form a part of for example an abutment list for a cladding board located above the guide rail.

An example of a preferred embodiment is described in the following and is illustrated in the accompanying drawings, in which.

Figure 1:
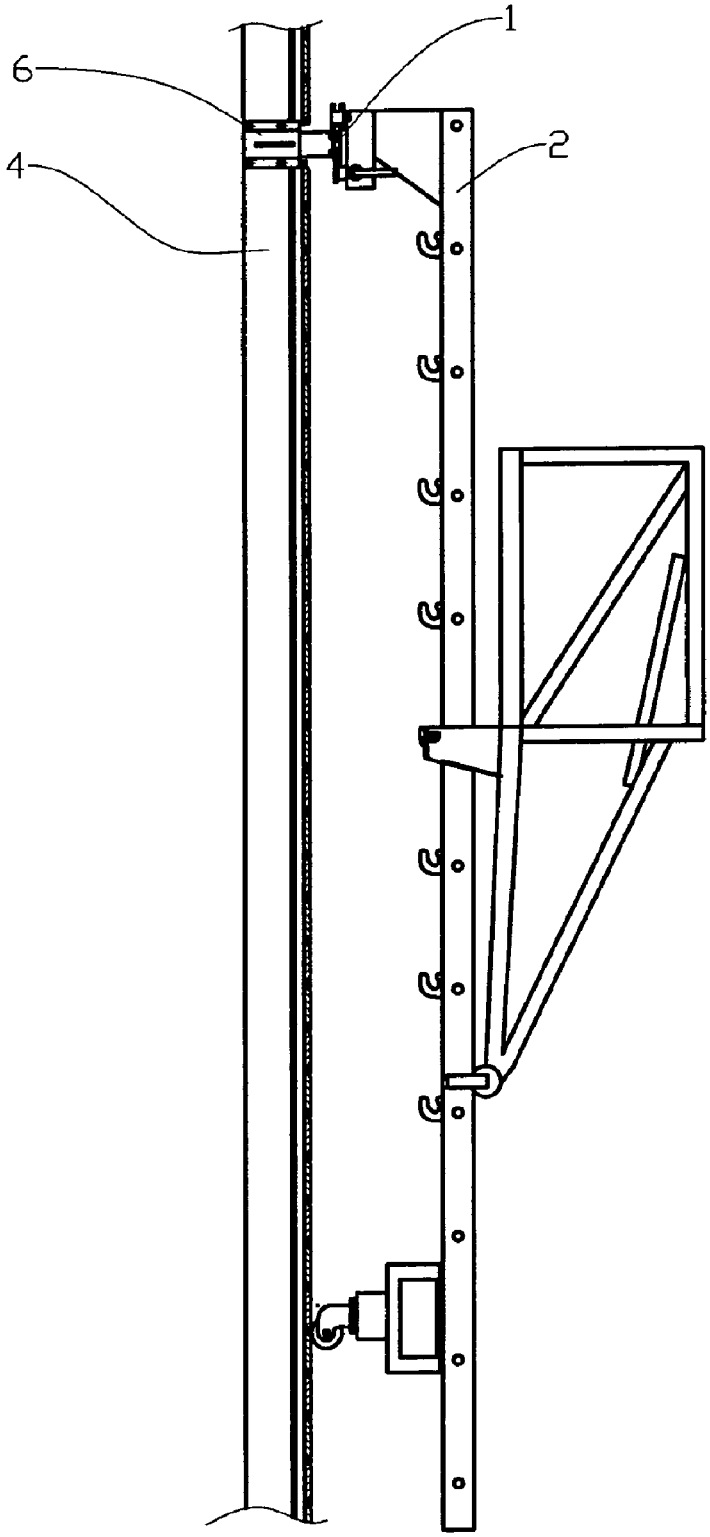
FIG. 1 shows a side view of a flying scaffold placed onto a building wall, is the scaffold being moveably connected to a guide rail in accordance with the invention.

In the drawings, reference numeral 1 denotes a guide rail for a scaffold 2, the guide rail 1 being connected to a building 4 by means of a telescopic guide 6.

Figure 2:
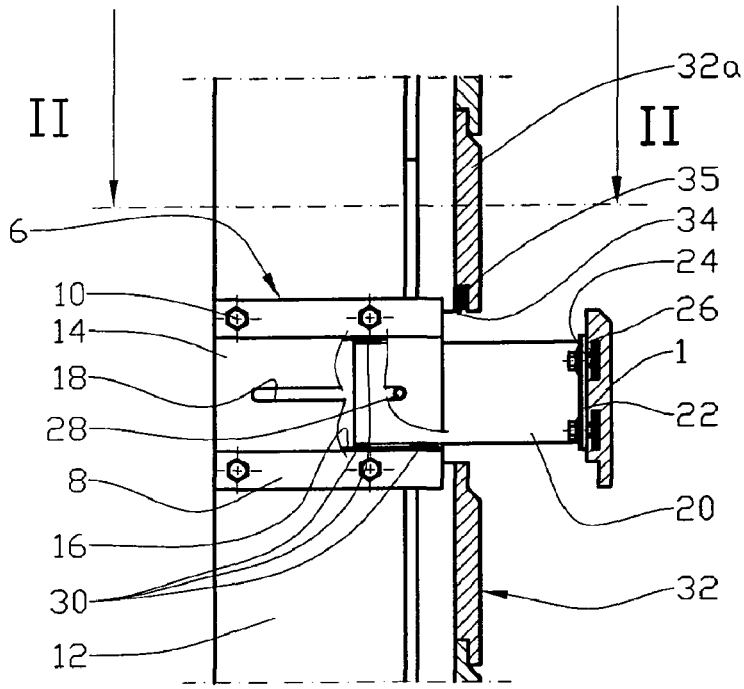
FIG. 2 shows, in larger scale and partially in section, a part of FIG. 1, but without the flying scaffold.

The telescopic guide 6 comprises a mounting bracket 8, see FIG. 2, the bracket 8 being connected to the structure 12, here in the form of uprights, of the building 4 by means of bolts 10.

The mounting bracket 8 is provided with a U-shaped profile 14 which, together with the mounting bracket 8, forms an opening 16 therethrough.

The U-shaped profile 14, at the rear portion thereof, is provided with an oblong slot 18 therethrough.

A rail bracket 20 fits into the opening 16 of the mounting bracket 8 in a complementary and moveable manner. The rail bracket 20 comprises an attachment plate 22 abutting the guide rail 1. The attachment bracket 22 is connected to the guide rail 1 by means of T-slot bolts 24 fitting into corresponding T-slots 26 in the guide rail 1.

A first stop 28 extends through the slot 18 and into the rail bracket 20, the first stop 28 being arranged in a manner allowing it to prevent the rail bracket 20 from being pulled out of the telescopic guide 6.

In this preferred embodiment, the rail bracket 20 is provided with slide blocks 30 abutting the inside of the U-shaped profile 14.

Figure 3:
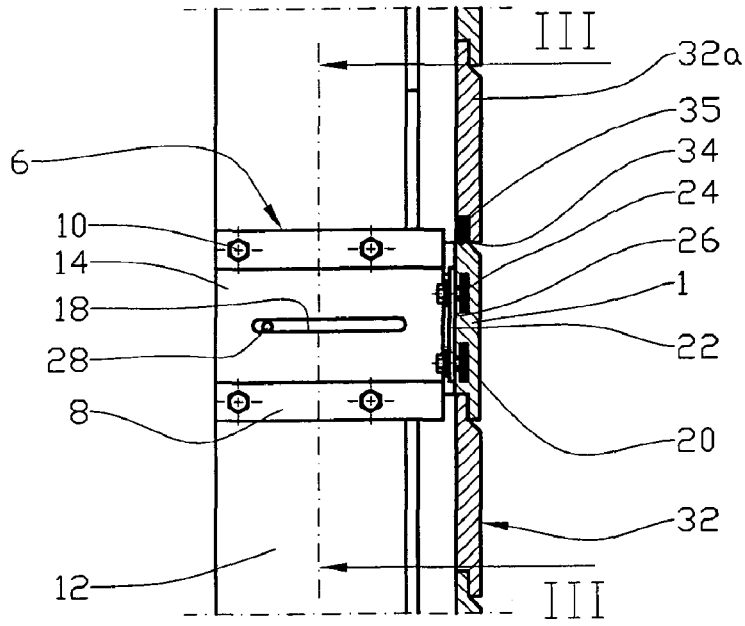
FIG. 3 shows the same as that of FIG. 2, but with the guide rail located in its inactive position.
Figure 4:
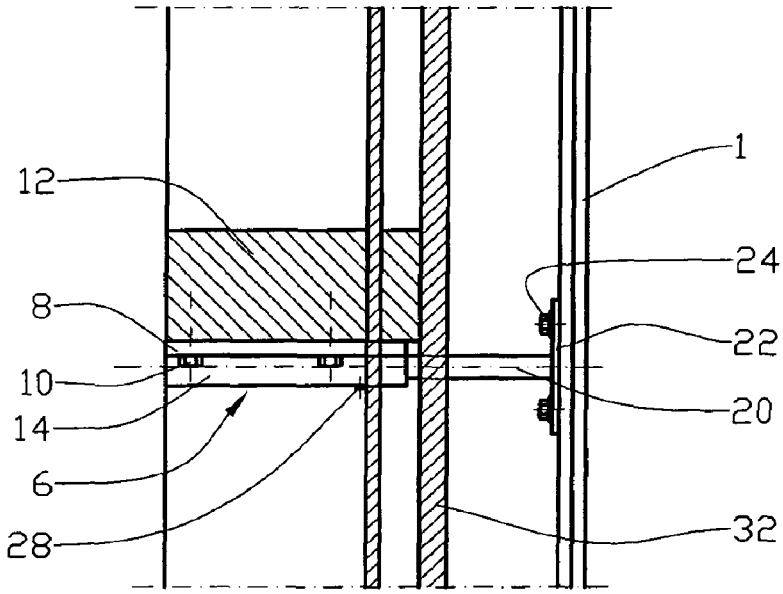
FIG. 4 shows a section taken along line II-II in FIG. 2.
Figure 5:
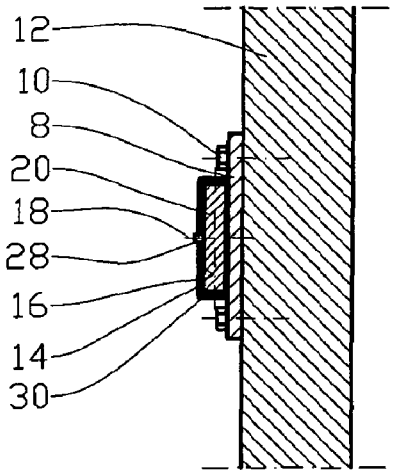
FIG. 5 shows a section taken along line III-III in FIG. 3.

In this embodiment, the guide rail 1 is provided with a cross-sectional shape substantially corresponding to the remainder of the facade cladding 32, which is in the form of cladding boards herein. However, the guide rail 1 is lacking the tongue of the facade cladding 32. A seal element 34 is provided in the groove of a cladding board 32*a* located above the guide rail 1, and as a part of an abutment list 35 for the facade cladding 32. The seal element 34 seals against the guide rail 1 when in its inactive position, see FIG. 3.

Figure 6:
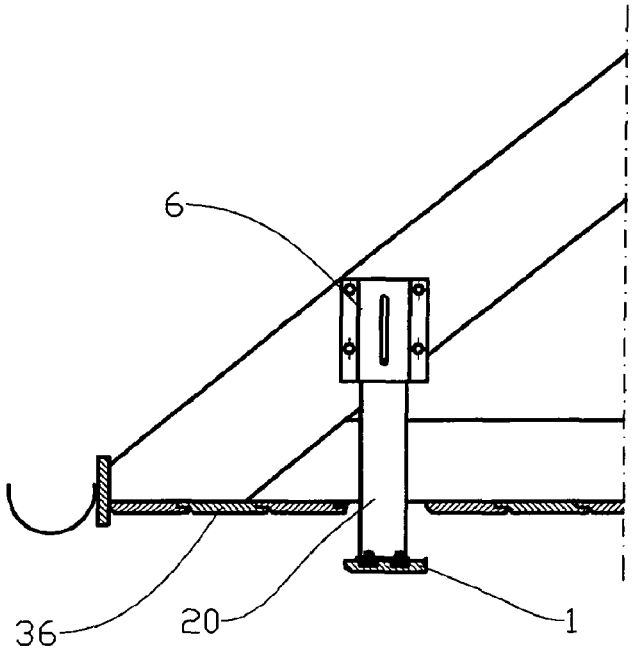
FIG. 6 shows an alternative embodiment, in which the guide rail is placed below a roof overhang.

In another embodiment, the guide rail 1 is suspended in a moveable manner below a roof overhang 36, see FIGS. 6 and 7.

Figure 7:
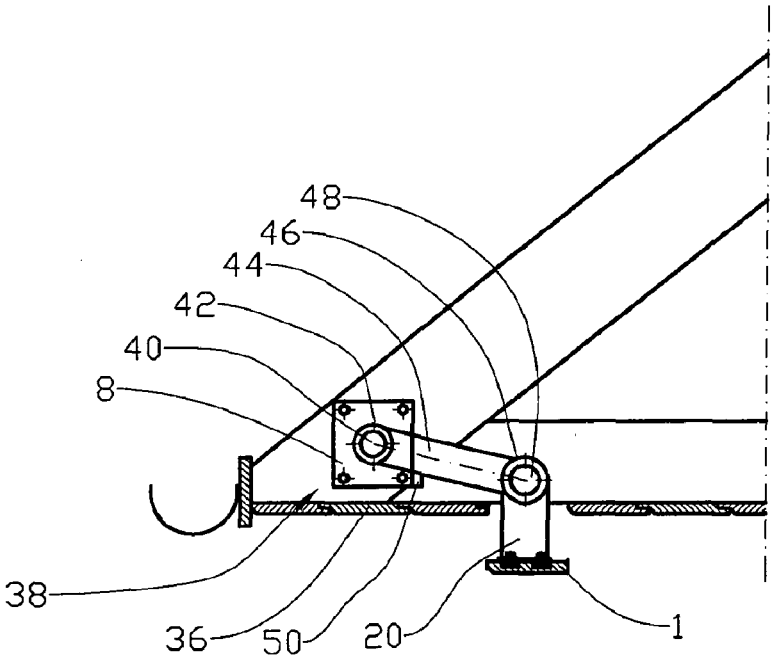
FIG. 7 shows a further embodiment, in which the guide rail is rotatably connected to a building.

In a further embodiment, the guide rail 1 is suspended in the building by means of a rotatable suspension 38, see FIG. 7.

Here the mounting bracket 8 is provided with a first shaft 40, a first hub 42 being rotatably connected to the first shaft 40. An arm 44 connects the first hub 42 to a second hub 46, the second hub 46 being rotatably connected to a second shaft 48, which is connected to the rail bracket 20.

A second stop 50, which is connected to the mounting bracket 8, prevents the arm 44 from rotating too far.

The invention claimed is:

1. A supporting guide rail for a scaffold, the guide rail being an elongated horizontal member with a top edge onto which the scaffold is hung and along which the scaffold moves horizontally thereon, to enable the scaffold to be movable over a part of a facade of a building, the facade exhibiting a plurality of facade cladding members, wherein one cladding member is movably attached to the building by telescopic guides, so as a) in an outer, active position spaced from the facade to form said guide rail, and b) in a retracted, inactive position to be located in a space between an upper adjacent cladding member and a lower adjacent cladding member to thereby form part of the facade along with the other facade cladding members, a lower edge of said upper adjacent cladding member having in a groove thereof a seal element, and wherein in said retracted, inactive position of said one cladding member the seal element seals against an upper edge of said one cladding member; and wherein the telescopic guides each comprise a guide rail supporting bracket telescopically movable in a guide having a mounting bracket attached to the building, the supporting bracket having a stop member movable in an oblong slot of the mounting bracket between outer and inner ends thereof, so as to define said active and inactive positions of said one cladding member, respectively.

2. The supporting guide rail according to claim 1, wherein an outer end of the guide rail supporting bracket has an attachment bracket for connecting the guide rail to the guide rail supporting bracket.

3. The supporting guide rail according to claim 2, wherein the guide rail is provided on a rearward facing side with T-slots, and wherein T-slot corresponding bolts fit into said T-slots and are connected with the attachment bracket.

4. The supporting guide rail according to claim 2, wherein slide blocks are provided on the rail supporting bracket to abut an inside face of mounting bracket.

5. The supporting guide rail according to claim 1, further wherein said one cladding member at its lower edge has a tongue portion configured to mate with and cover an outside of a tongue portion the lower adjacent cladding member at an upper edge thereof.

6. The supporting guide rail according to claim 2, wherein the guide rail supporting bracket has a rectangular cross-section with a side at a right angle to said upper edge of said one cladding member being larger than a side which is parallel to said upper edge.

7. The supporting guide rail according to claim 1, wherein the scaffold is provided with two sets of pulleys, each set of pulleys comprising a pulley configured to be rolling on the upper edge of the guide rail, and a pulley configured to roll towards a lower edge portion of the guide rail.

* * * * *